US005180354A

United States Patent [19]

Jones

[11] Patent Number: 5,180,354

[45] Date of Patent: Jan. 19, 1993

[54] ROTARY CUFF EXERCISE MACHINE

[75] Inventor: Gary A. Jones, Falmouth, Ky.

[73] Assignee: Hammer Corporation, Cincinnati, Ohio

[21] Appl. No.: 617,606

[22] Filed: Nov. 26, 1990

[51] Int. Cl.[5] ..... A63B 21/00

[52] U.S. Cl. ..... 482/133; 482/100; 482/142

[58] Field of Search ..... 272/116, 118, 122, 123, 272/124, 130, 134, 138, 143, 144; 482/92, 98, 99, 100, 101, 102, 103, 106-108, 109, 113, 133-138, 123, 142-144

[56] References Cited

U.S. PATENT DOCUMENTS

| | | | |
|---|---|---|---|
| 3,858,873 | 1/1975 | Jones | 272/117 |
| 3,998,454 | 12/1976 | Jones | 272/117 |
| 4,247,098 | 1/1981 | Brenthan | 272/134 |
| 4,556,216 | 12/1985 | Pitkanen | 272/126 |
| 4,720,099 | 1/1988 | Carlson | 272/134 |
| 4,898,381 | 2/1990 | Gordon | 272/134 |

OTHER PUBLICATIONS

"Leverage Machines" by Nautilus Instruction Manual.

*Primary Examiner*—Richard J. Apley
*Assistant Examiner*—Jerome Donnolly
*Attorney, Agent, or Firm*—Wood, Herron & Evans

[57] ABSTRACT

A rotary cuff exercise machine includes a frame, an elongated platform aligned along a vertical midplane through the frame, and two sides rotatably connected to the frame on opposite sides of the midplane. Each rotatable side includes a horizontally pivotal lever, a hub for holding removable weights on one end of the lever, at least one actuating pad connected to the lever away from the hub for pivotally moving the weighted lever and an elbow rest located below the actuating pad for supporting the elbow during pivotal movement. With elbows supported on the elbow rests, and the hands bearing against the actuating pads, an exerciser lying face up on the platform may pivotally move the weighted levers, through either an internal rotation or an external rotation, depending upon the direction the exerciser is pointed, to exercise the muscles associated with the rotary cuff joint.

19 Claims, 4 Drawing Sheets

ROTARY CUFF EXERCISE MACHINE

FIELD OF THE INVENTION

This invention relates to a rotary cuff exercise machine.

BACKGROUND OF THE INVENTION

Among both athletes and non-athletes, the popularity of weight training exercise has substantially increased in the past ten years. In addition to the use of traditional "free weights", i.e., plate-loaded barbells or dumbbells, weight training exercises are also performed with a number of specialized exercise machines that work a particular muscle group through a prescribed motion or exercise maneuver. Generally, for most exercise maneuvers that may be performed either on a machine or with free weights, exercise machines tend to be safer. Moreover, from a practical standpoint, certain exercise maneuvers are simply more efficient and beneficial when performed on an exercise machine, particularly when the major purpose for performing weight training is to rehabilitate an injured limb.

In addition to rehabilitation, another purpose of weight training is the prevention of injuries. By building up the muscles associated with a particular movement and the joints involved with that movement, the likelihood of injury can be reduced.

One relatively common injury among baseball pitchers is that of damage to the rotary cuff. An injury to this part of the shoulder can ruin a career. Among athletes who participate in sports other than baseball, either professionally or simply for enjoyment, damage to the rotator cuff can impair even simple movements of the arm, or at least make performance of these movements extremely painful. In short, for athletes participating at all levels of competition, there exists a genuine need to strengthen muscles associated with the shoulder to reduce the occurrence of painful damage to, or physical impairment of the rotator cuff.

While this need is rather simply stated, it is not so easily met. The shoulder joint is a ball and socket type joint. To effectively exercise the muscles associated with the rotary cuff joint, an exerciser's arm must be extended outwardly from the torso, in a direction generally perpendicular to the torso. From this position, forward movement of the lower arm and hand produces "internal rotation" of the upper arm in its socket, while rearward movement produces "external rotation" of the upper arm in its socket.

It is difficult to isolate the rotary cuff joint when performing either of these two rotary movements with a dumbbell or a barbell. First of all, if the elbow is not supported, the force of any weight grasped by the hand will be felt by the entire arm and will distort the muscular effect to such an extent that the desired benefits to the shoulder joint will not be achieved. If the elbow is supported, it becomes necessary to use the other arm to hand off the desired weight to the exercising arm.

While this physical inconvenience may be tolerable when exercising one arm at a time, it presents problems for an exerciser wishing to exercise both arms simultaneously. The exerciser must grasp the weights with both arms and then move to the desired exercise position. After completing the exercise, the reverse movement is required. Because many weight training exercises are performed to the point of fatigue, or until failure occurs, movement of the arms and hand-held weights out of an elbow supported rotary cuff exercise position may present a danger of dropping the weights. In short, the inherent dangers associated with moving two separate weights into and out of a desired rotary cuff exercise position may outweigh the benefits derived from performance of the exercise.

On the other hand, it seems that the relatively high cost of exercise machines has effectively diminished the incentive to design and develop an exercise machine dedicated solely to exercising the rotary cuff joint through both the internal and external rotation. As a result, although many exercise machines do provide some muscular benefit for the shoulder, none are designed specifically for the purpose of isolating and exercising the shoulder muscles associated with the rotary cuff joint.

It is an object of this invention to provide an exercise machine that isolates the shoulder muscles during a rotary cuff exercise maneuver to maximize muscular benefit to the rotary cuff joint.

It is another object of this invention to provide a rotary cuff exercise machine that an athlete may use to reduce susceptibility to rotary cuff injury and/or rehabilitate a rotary cuff injury that has already occurred.

SUMMARY OF THE INVENTION

To these ends, a rotary cuff exercise machine includes a frame with a central platform that supports an exerciser lying down, face up, along a vertical midplane, with two sides located on opposite sides of the midplane. Each side has an elbow rest, and a weighted lever located thereabove that the exerciser may pivot to perform either a internal rotation or an external rotation, depending upon which direction he or she is pointed.

The elbow rests assist in providing an unstressed rotational movement for the upper arm during performance of an upper arm rotary cuff exercise maneuver, thereby optimally isolating the muscles of the rotary cuff joint during both internal rotation and external rotation. Preferably, the elbow rests tilt downwardly toward the midplane.

Because this exercise machine is designed for use while lying face up, on the platform, the exerciser has sufficient leverage to perform the exercise maneuver properly, while the use of additional muscles is restricted, or minimized. The platform preferably includes three sections, with a middle section and two exterior sections that decline outwardly.

The sides, or side support structures are rotatable with respect to the frame about spaced, vertical axes. This feature enables the exerciser to change the angle of the upper arm with respect to its socket during rotational exercise, thereby providing some degree of selectability in physically orienting the body with respect to the lever locations. This latter feature also enables the exerciser to reduce the amount of joint stress that might otherwise be experienced if the rotational movement were confined along planes that are parallel to the vertical midplane of the frame. As explained in applicant's copending patent application Ser. Nos. 514,869 and 514,839, one disadvantage of most exercise machines is that they do not seem to quite "fit" the natural musculoskeletal makeup of a human being. With rotatable side support structures, downwardly tilted elbow rests, outwardly declined platform sections, and a platform for supporting an exerciser in face-up position, this rotary cuff exercise machine accommodates the natural musculoskeletal makeup of the human body.

According to a preferred embodiment of the invention, this rotary cuff exercise machine includes a frame, three platform sections connected to the frame along a vertical midplane and a pair of side support structures that are pivotally connected to the frame on opposite sides of the midplane. Each side support structure includes a pivotal lever that holds a selected number of weighted plates at one end, at least one actuating pad that an exerciser supported on the platform section works against to pivot the weighted lever during either an internal or an external rotation, and an elbow rest located below the pad for supporting the elbow during rotation. Preferably, each side includes a pair of spaced actuating pads mounted to the free end of an arm that connects to the lever adjacent to the lever's pivot point. The additional actuating pad enables the exerciser to choose between two ranges of pivotal motion. For additional selectivity, each side also includes a pin arrangement that coacts with the lever to enable the exerciser to selectively vary the initial, starting angle of the lever.

When an exerciser wishes to use this rotary cuff exercise machine, the sides are set at a desired angle with respect to the midplane, preferably at an angle of less than ninety degrees. With elbows supported on the elbow rests, and the hands bearing against the selected pair of actuating pads, an exerciser lying face up on the platform performs either an internal rotation or an external rotation against the weight held by the lever or levers, depending upon the direction that he or she is pointed. By rotating the sides to an appropriate, less than ninety degree position, and then turning around to point in the opposite direction, the exerciser may perform the other of the two rotational motions.

These and other features will be more readily understood in view of the following detailed description.

DETAILED DESCRIPTION OF THE DRAWINGS

Figure 1:
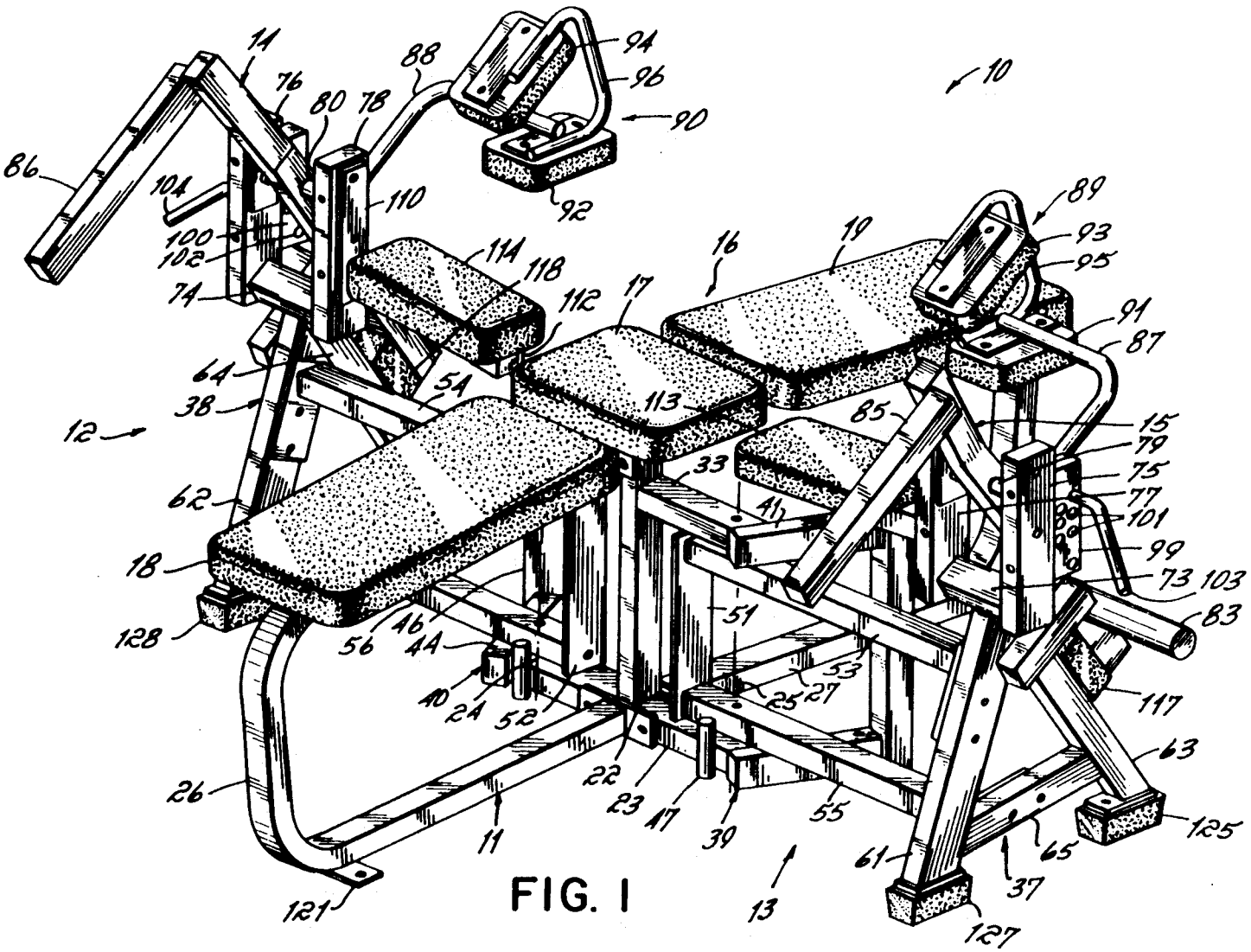
FIG. 1 is a perspective view of a rotary cuff exercise machine in accordance with a preferred embodiment of the invention.

FIGS. 1–4 show a rotary cuff exercise machine 10 in accordance with a preferred embodiment of the invention. The machine 10 includes a frame 11 with two pivotally connected sides, or side support structures 12 and 13, and two levers 14 and 15, pivotally connected to the sides 12 and 13, respectively. The sides 12 and 13 pivot about spaced vertical axes, 24 and 25, respectively, located on opposite sides of the machine 10, while the levers pivot about horizontal axes that move with their respective sides. The frame 11 also includes a platform 16 upon which an exerciser (not shown) is supported during the performance of either an internal forward rotation or an external rearward rotation of the levers, depending upon which direction he or she is pointed. To accommodate both motions, platform 16 includes a middle section 17, a forward section 18 and a rearward section 19. Preferably, the forward section 18 and the rearward section 19 decline outwardly from the middle section 17.

The frame 11 further includes a vertical post 22 supported by a horizontal base 23. Middle section 17 is located at the top of vertical post 22. Forward and rearward sections 18 and 19 are supported by bent metal legs 26 and 27, respectively.

Figure 2:
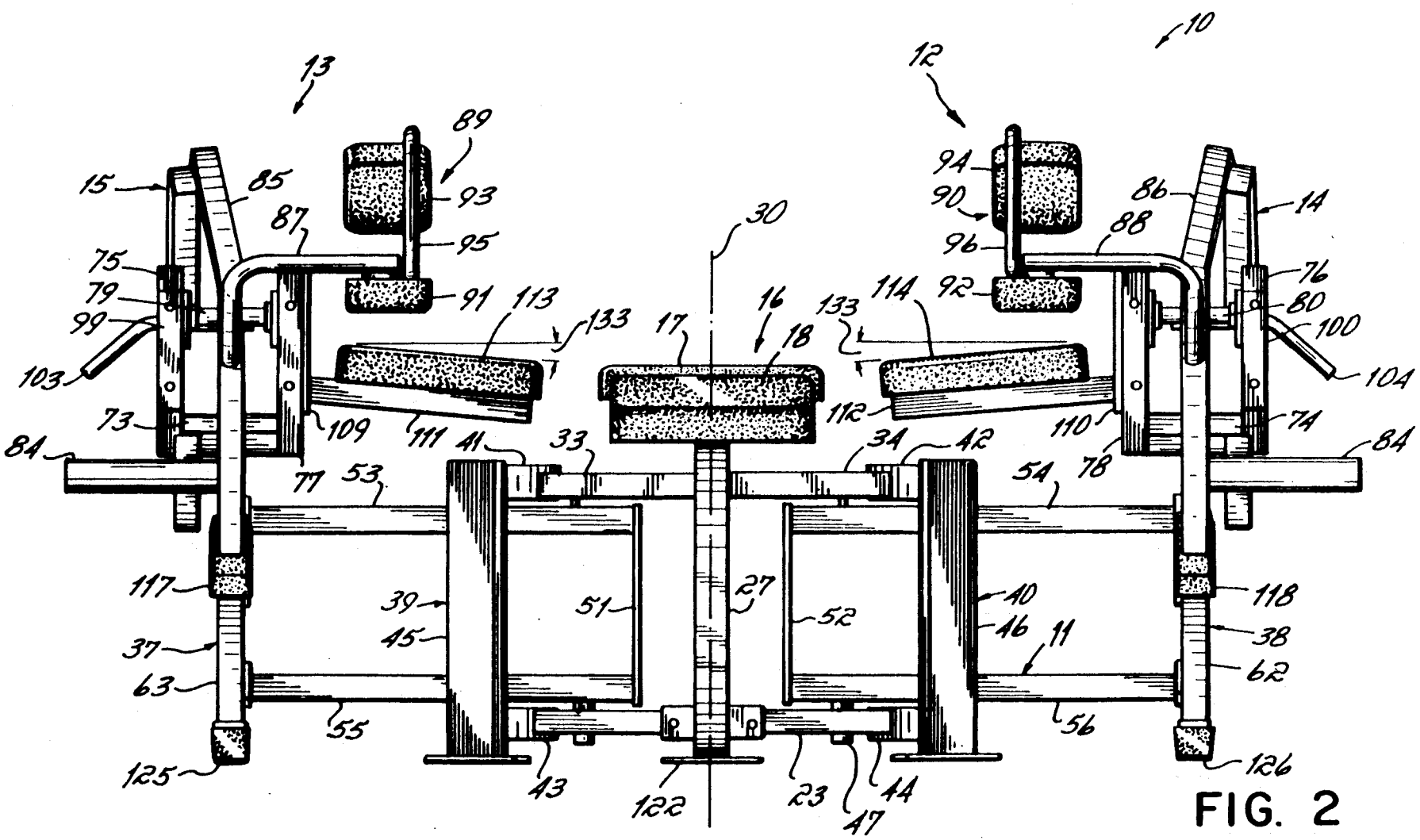
FIG. 2 is a rear view of the rotary cuff exercise machine shown in FIG. 1.

The frame 11 is symmetric with respect to a vertical midplane 30 that bisects the machine 10 along platform 16, as shown in FIG. 2. Odd numbers are used to designate component parts on one side of the machine, and even numbers designate similar components for an opposite side of the machine.

Brace 33 is located above and parallel to the end of brace 23. Side support structure 37 generally designates all of the lever supporting components located on the respective side of the machine 10. The side support structure 37 is pivotal with respect to those portions of the frame 11 lying along axis 30. Stabilizing structure 3 is rigidly secured at its top to brace 33 and at its bottom to base 23. The stabilizing structure 39 includes an upper horizontal member 41, a lower horizontal member 43 and an intermediate vertical member 45. The stabilizing structure 39 also includes a stop 47 welded to a side of base 23. The opposite side of the machine 10 includes brace 34, side support structure 38, stabilizing structure 40, upper horizontal member 42, lower horizontal member 44, intermediate vertical member 46 and stop 48.

Side support structure 37 further includes an interior plate 51, an upper side member 53, a lower side member 55, a front leg 61, a rear leg 63 and a brace 65. Preferably, side member 55 is connected to brace 65, and the upper side member 53 is rigidly secured to leg 61. A horizontal support 73 is secured to a top end of front leg 61. A pair of uprights 75 and 77 extend upwardly from outer ends of horizontal support 73. Upright 77 is angled slightly inwardly toward plane 30, while upright 75 is substantially vertical. An axle 79 is rotatably connected between upright 75 and 77 by bearings. A pillow block bearing sold by Browning, Part No. VF 25 116 has proved suitable. These bearings require maintenance only once a year, which consists of one shot of lubricating oil.

Lever 15 is rigidly connected to the center of axle 79, and is rotatable with respect to the frame 11 about an axis defined by the axle 79. The lower end of the lever 15 includes a hub 83 which is adapted to hold at least one removable weight plate thereon.

Similarly, on the opposite side of the machine 10, side support structure 38 includes an interior plate 52, an upper side member 54, a lower side member 56, a front leg 62, a rear leg 64 and a brace similar to brace 65. A pair of uprights 76 and 78 extend upwardly from the outer ends of horizontal support 74 that is secured to the top of front leg 62. An axle 80 is rotatably connected between uprights 76 and 78 by bearings, and lever 14 includes hub 84. For each lever, the hub is preferably located about 15.0" from the axis of rotation.

The weight plates held by the hubs provide a predetermined resistance to pivotal movement of the levers by an exerciser supported on the platform 16. An upper end of the lever 15 includes a counterweight 85 which substantially counterbalances the weight of hub 83 and the lower portion of lever 15 when there are not weights held by the hub 83. An arm 87 extends substantially perpendicularly from lever 15. The arm 87 includes a centrally located bend that extends inwardly toward axis 30. Actuating means, designated generally by numeral 89, located at the free end of arm 87 enables the lever 15 to be acted upon by an exerciser to perform either a forward internal rotation while supported on section 18, or a rearward external rotation while supported on section 19. Similarly, lever 14 includes a counterweight 86 that counterbalances the weight of hub 84. Lever 14 also includes an arm 88 and actuating means 90 located at a free end thereof.

These two exercise motions are performed by directing force against the actuating means 89 and 90 to pivotally move weights supported on hubs 83 and 84, respectively. More particularly, the actuating means 89 includes a lower pad 91, an upper pad 93, and a bar 95 which is rigidly secured to the free end of arm 87, and which supports both the upper and the lower pads. For lever 14, actuating means 90 includes a lower pad 92, an upper pad 94 and a bar 96 rigidly secured to arm 88. Either of the pads may be used for performing either an internal forward rotation while supported on section 18 or an external rearward rotation when supported on rearward section 19. The additional pad provides the exerciser some versatility in choosing a range of motion. Depending on the exerciser's position, either an external or an internal rotation may be performed, simultaneously with both arms, alternately with both arms, or simply with one arm.

A block 99 mounted alongside upright 75 includes holes 101 sized to receive a pin 103 which enables an exerciser to vary the initial, at rest angle of the lever 15 with respect to the machine 10. Similarly, block 100 on the opposite side includes hole 102 sized to receiver pin 104. The feature provides additional versatility in choosing a range of motion and is particularly useful during rehabilitation, when it is initially desirable to exercise the rotary cuff through a reduced range of motion. During the initial stage of rehabilitation, it is also desirable to exercise the rotary cuff joint against very low weight resistance. The counterbalances on both sides of the machine 10 assist in reducing the minimum force necessary to perform a rotational movement.

FIG. 2 shows a plate 109 secured to the interior side of upright 77. Plate 109 supports angled member 111 which in turn supports an elbow rest 113 alongside of middle section 17. A pad 117 secured to rear leg 63 limits downward movement of the lower end of lever 15 with respect to frame 11. The metal legs below forward and rearward sections 18 and 19 of platform 16 are preferably supported by plates 121 and 122, respectively. The bottoms of rotatable side support 37 are supported by bottom pads 125 and 127.

Similarly, on the other side, a plate 110 is secured to upright 78. Plate 110 supports an angled member 112 which in turn supports an elbow rest 114. A pad 118 secured to rear leg 64 limits movement of lever 14. Side support 38 is supported by bottom pads 126 and 128.

Figure 3:
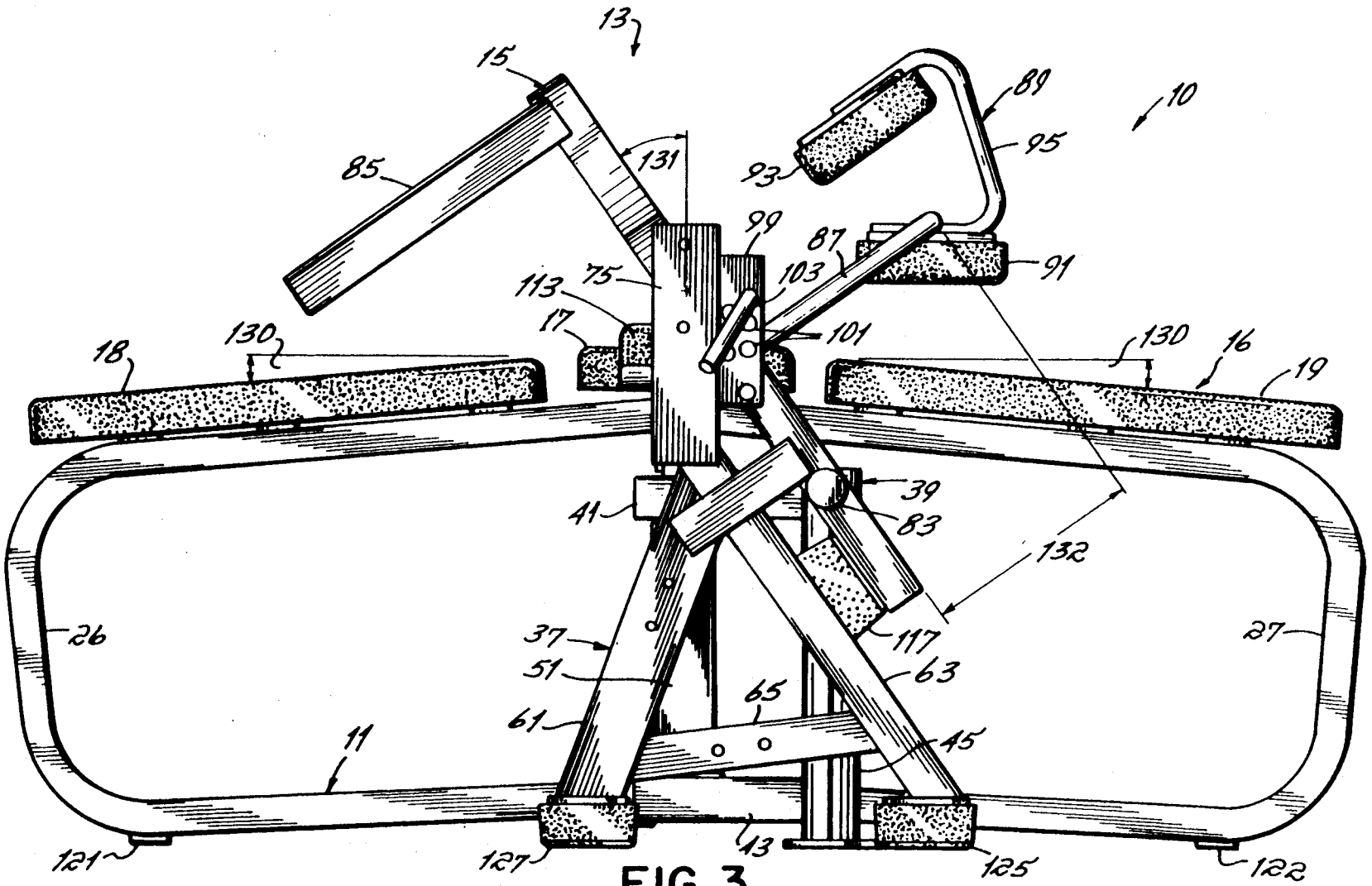
FIG. 3 is a side view of the rotary cuff exercise machine shown in FIG. 1.
Figure 4:
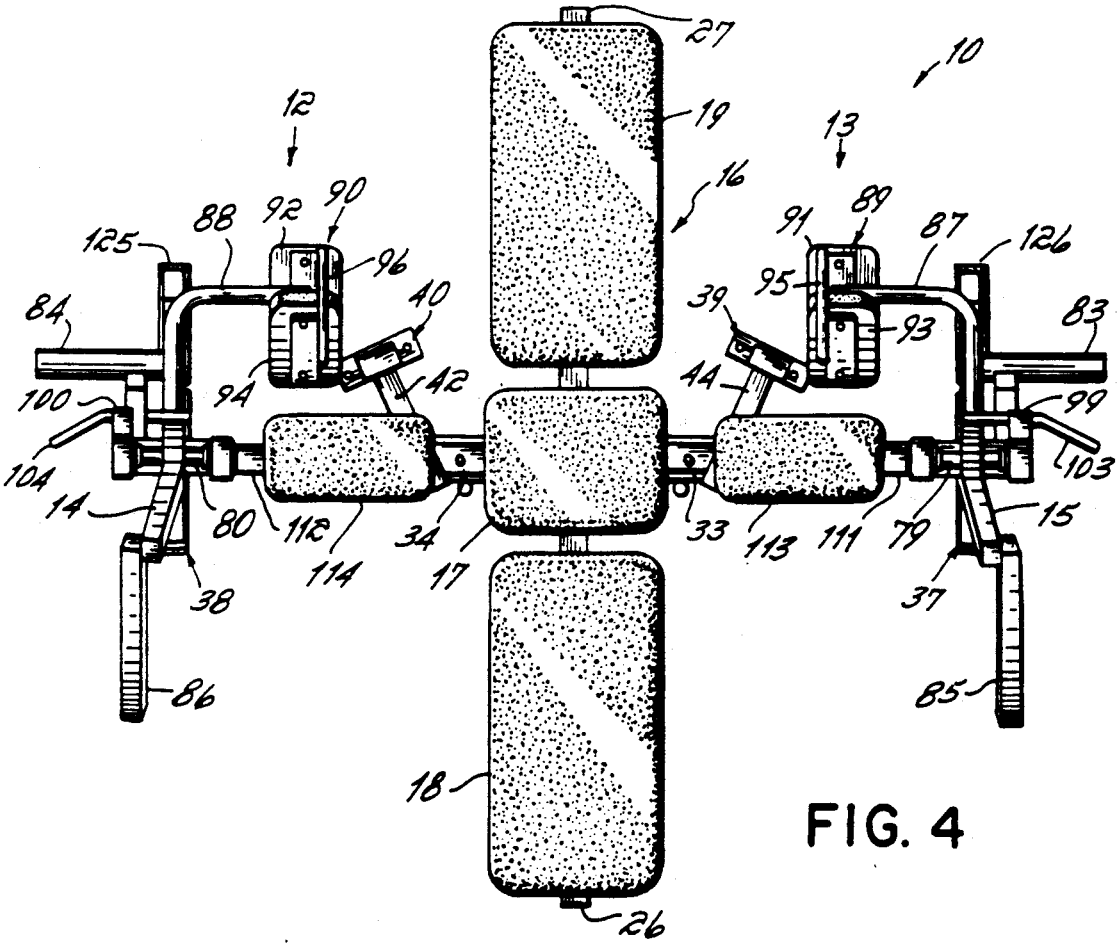
FIG. 4 is a top view of the rotary cuff exercise machine shown in FIG. 1.

As shown in FIG. 3, while middle section 17 is substantially horizontal, forward and rearward sections 18 and 19 both decline outwardly. Numeral 130 designates this angle of decline, and is preferably about 5°. FIG. 3 also shows the initial, at rest, angles of the levers with respect to vertical. This angle is designated by numeral 131, and is preferably about 35°. For each lever 14 and 15, the distance from the free end of the arm 88 or 87 to the pivot axis is preferably about 15.0", and designated by numeral 132. FIG. 2 shows that elbow supports 113 and 114 decline inwardly toward midplane 30. This angle of downward decline is designated by numeral 133 and is preferably about 5°.

In operation, an exerciser first adjusts the locations of the side support structures 37 and 38 with respect to vertical midplane 30, depending upon whether internal or external rotation is to be performed. If an internal or forward rotation exercise is to be performed, the sides 37 and 38 will be rotated slightly toward lower section 18. Conversely, if an external, rearward rotation is to be performed, the sides 37 and 38 are rotated slightly toward rear section 19. In short, during the performance of either an internal or external rotation, the angle between the vertical midplane and each side should be slightly less than 90°. As explained in the summary, this feature more naturally accommodates the musculoskeletal makeup of the human body.

With the sides rotated to a preferred angle, the exerciser selects and places a number of weighted plates upon hubs 83 and 84 to achieve a desired weight resistance. The exerciser then lies upon one of the selected outer sections, and rests his or her head upon section 17. By placing the elbows upon the elbow rests and by locating the hands against the desired pads and applying force against the pads, with the elbows at rest, the levers are pivoted with respect to the frame as the upper arm of the exerciser rotates in its ball-in-socket joint. Either one of the pairs of upper and lower pads may be used, if desired. When internal rotational exercise is finished, sides 37 and 38 are rotated with respect to the midplane 30 to perform an external rotation. As indicated previously, this machine 10 optimally isolates the muscles associated with the rotary cuff joint, thereby providing maximum muscular benefit during either an internal rotation or an external rotation.

While a preferred embodiment of the invention has been described, it is to be understood that the invention is not limited thereby and that in light of the present disclosure, various other alternative embodiments will be apparent to a person skilled in the art. For instance, the exact structural orientation of some of the parts or portions of the frame 11 is not critical, so long as the positioning of the levers and elbow supports with respect to the platform is maintained. Accordingly, it is to be understood that changes may be made without departing from the scope of the invention as particularly set forth and claimed.

I claim:

1. A rotary cuff exercise machine comprising:

a frame;

a substantially horizontal platform connected to the frame along a vertical midplane;

a lever pivotally connected to the frame along side the platform, one end of the lever adapted to hold at least one removable weight;

an arm extending outwardly from the lever; and actuating means mounted at a free end of the arm and adapted to be acted upon by one arm of an exerciser to pivot the lever with respect to the frame during performance of an internal rotary cuff rotation while lying face up on the platform with the exerciser's legs pointed in a first direction and during performance of an external rotary cuff rotation by the other arm of the exerciser while lying face up on the platform with the legs pointed in an opposite direction, said internal and external rotations being performed with an upper portion of the respective exerciser's arm extended in a direction perpendicular from the the torso of the exerciser.

2. The rotary cuff exercise machine of claim 1 and further comprising:

a side support structure pivotally connected to the frame about an axis perpendicular to the pivot axis of the lever, the lever, the arms and the actuating means being mounted to said pivotally connected side support structure.

3. The rotary cuff exercise machine of claim 2 and further comprising:

an elbow support surface carried by the side support structure.

4. The rotary cuff exercise machine of claim 3 wherein the elbow support surface declines downwardly toward the vertical midplane.

5. The rotary cuff exercise machine of claim 1 further comprising:

a counterweight located at an end of the lever opposite said one end.

6. The rotary cuff exercise machine of claim 1 and further comprising a pair of actuating pads, each actuating pad having a surface adapted to be acted against to pivot the lever with respect to the frame.

7. The rotary cuff exercise machine of claim 1 and further comprising:

means for selectively adjusting an initial, at rest angle of the lever with respect to the frame.

8. The rotary cuff exercise machine of claim 1 and further comprising:

an additional lever pivotally connected to the frame on an opposite side of the vertical midplane, the levers being mirror images of each other with respect to the vertical midplane.

9. The rotary cuff exercise machine of claim 8 wherein the platform comprises:

a middle section with a horizontal top surface; and two exterior, longitudinal sections aligned along the vertical midplane on opposite sides of the middle section and declining outwardly from the middle section.

10. A rotary cuff exercise machine comprising:

a frame;

a substantially horizontal platform secured to the frame along a vertical midplane; the platform having opposite ends aligned on the midplane;

two side support structures, the side support structures connected to the frame on opposite sides of the vertical midplane about half way between the opposite ends of the platform; and two levers, each lever pivotally connected to a side support structure, each lever including means for providing a predetermined resistance to pivotal movement and an actuating pad for use by an exerciser lying face up on the platform to pivotally move the lever against the predetermined resistance during performance of an internal upper arm rotary cuff exercise maneuver when the legs of the exerciser are pointed in a first direction and during performance of an external upper arm rotary cuff exercise maneuver when the legs of the exerciser are pointed in a second direction, opposite the first direction, wherein said internal and external upper arm rotary cuff exercise maneuvers are performed with the exerciser supported face up on the horizontal platform and with the lower arm contacting the actuating pad and with the respective upper arm extended in a direction perpendicular from the torso of the exerciser, wherein during both internal and external rotary cuff exercise maneuvers, each lever pivots about an axis substantially aligned with the upper arm and, oriented perpendicular to the lower arm of the exerciser, the levers being independently pivotal with respect to the frame.

11. The rotary cuff exercise machine of claim 10 wherein the sides are hingedly connected to the frame about spaced parallel vertical axes.

12. The rotary cuff exercise machine of claim 10 wherein each said means for providing a predetermined resistance includes a hub for holding at least one removable weight at a lower end thereof.

13. The rotary cuff exercise machine of claim 10 and further comprising:

two arms, each arm having one end connected to a lever adjacent the respective lever pivot point and supporting an actuating means at an opposite end thereof.

14. The rotary cuff exercise machine of claim 13 and further comprising:

two additional actuating pads, each additional pad supported by a respective arm adjacent another pad on the same side of the machine.

15. The rotary cuff exercise machine of claim 10 and further comprising:

a pair of elbow rests located on opposite sides of the midplane, each elbow rest located between the platform and the respective lever.

16. The rotary cuff exercise machine of claim 15 wherein the elbow rests tilt inwardly toward the midplane.

17. The rotary cuff exercise machine of claim 10 wherein each side further comprises:

means for selectively adjusting the initial, at rest position of the respective lever.

18. The rotary cuff exercise machine of claim 10 wherein the platform includes three separate sections aligned along the midplane and the outer two of the sections decline away from a middle section.

19. A rotary cuff exercise machine comprising:

a frame;

an elongated substantially horizontal platform secured to the frame along a vertical midplane;

a first rotary cuff exercise means for exercising a rotary cuff joint of an exerciser, said means connected to the frame on a side of the midplane, the rotary cuff exercise means adapted to be pivoted with respect to the frame through an internal rotation by a first arm of the exerciser lying face up on the platform when the exerciser's legs are pointed in a first direction and through an external rotation by a second arm of the exerciser when the exerciser is lying face up on the platform with legs pointed in an opposite direction, said internal and external rotations being performed with an upper portion of the respective exerciser's arm extended in a direction perpendicular from the torso of the exerciser;

a second rotary cuff exercise means for exercising a rotary cuff joint of an exerciser, the first and second rotary cuff exercise means located on opposite sides of the midplane and being mirror images of each other with respect to the midplane;

two sides, each side pivotally connected to the frame and hingable about a vertical axis spaced from the midplane; each side supporting one rotary cuff exercise means; and a pair of elbow rests, each elbow rest connected to a side of the frame beneath a respective rotary cuff exercise means.

* * * * *

UNITED STATES PATENT AND TRADEMARK OFFICE

CERTIFICATE OF CORRECTION

PATENT NO. : 5,180,354

DATED : January 19, 1993

INVENTOR(S) : Gary A. Jones

It is certified that error appears in the above-identified patent and that said Letters Patent is hereby corrected as shown below:

Column 4, Line 19, "3" should read --39--.

Signed and Sealed this

Twenty-second Day of March, 1994

Bruce Lehman

*Attest:*

BRUCE LEHMAN

*Attesting Officer*

*Commissioner of Patents and Trademarks*